United States Patent [19]

Hokama et al.

[11] Patent Number: 4,767,648

[45] Date of Patent: Aug. 30, 1988

[54] METHOD OF ACCOMPLISHING RAPID AND DURABLE FRENCH MANICURE

[75] Inventors: Yosh Hokama, Torrance; Luis Romero, Lawndale, both of Calif.

[73] Assignee: Spencer R&D Inc., Gardena, Calif.

[21] Appl. No.: 66,267

[22] Filed: Jun. 25, 1987

[51] Int. Cl.[4] ..... A01N 1/00; A45D 31/00

[52] U.S. Cl. ..... 428/15; 132/73; 156/61

[58] Field of Search ..... 132/73; 156/61; 424/61; 428/15

[56] References Cited

U.S. PATENT DOCUMENTS

| | | | |
|---|---|---|---|
| 2,073,867 | 3/1937 | Feigenbaum | 132/73 |
| 3,228,404 | 1/1966 | Turner | 132/73 |
| 3,790,801 | 2/1974 | Coleman | 250/453 |
| 3,928,113 | 12/1975 | Rosenberg | 156/344 |
| 4,058,442 | 11/1977 | Lee, Jr. et al. | 204/159.12 |
| 4,135,526 | 1/1979 | Matranga et al. | 132/73 |
| 4,229,431 | 10/1980 | Lee, Jr. et al. | 424/61 |
| 4,407,310 | 10/1983 | Jadow | 132/73 |
| 4,554,935 | 11/1985 | Hokama | 132/73 |
| 4,682,612 | 7/1987 | Giuliano | 132/73 |

*Primary Examiner*—Robert A. Dawson

*Attorney, Agent, or Firm*—William W. Haefliger

[57] ABSTRACT

A method for rapidly accomplishing a durable french manicure, employing nail polish, that includes the steps:

(a) providing a flexible tab having a white or near-white upper surface that is compatible to nail polish, the tab having the shape of an over-sized fingernail forward tip portion, (b) applying and adhering the tab to the fingernail forward tip portion so that the tab has extent beyond the forward edge of the fingernail forward tip portion, (c) then trimming off said tab extent beyond the forward edge of the fingernail forward tip portion, (d) then applying translucent liquid nail polish to the fingernail upper surface and to cover said tab upper surface, and allowing the polish to dry, (e) whereby the fingernail has a glossy upper surface that is white or near-white only at its forward tip portion.

19 Claims, 1 Drawing Sheet

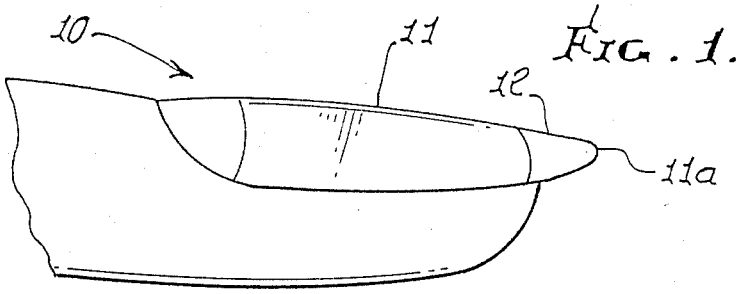
FIG. 1.
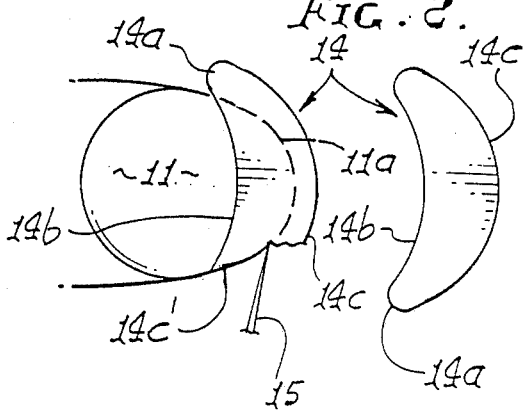
FIG. 2.
FIG. 3a.
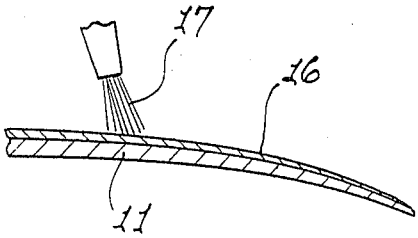
FIG. 3b.
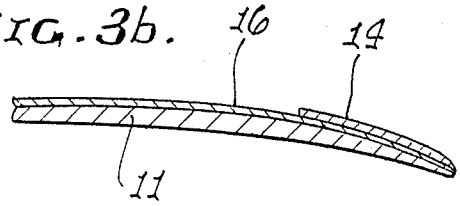
FIG. 3c.
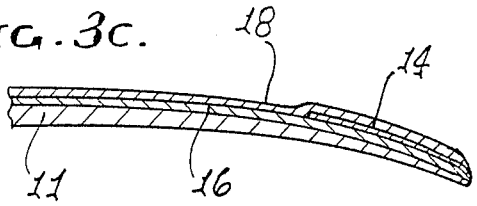
FIG. 2a.
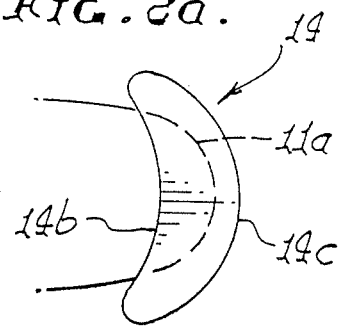
FIG. 4.
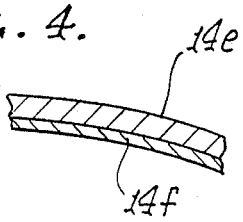
FIG. 5.
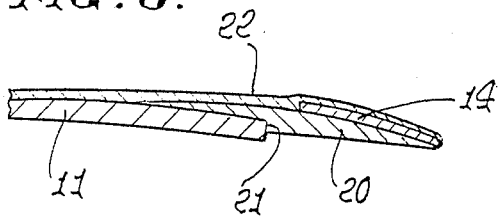
FIG. 6.
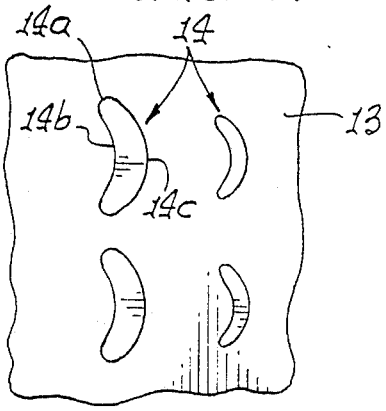

METHOD OF ACCOMPLISHING RAPID AND DURABLE FRENCH MANICURE

BACKGROUND OF THE INVENTION

This invention relates generally to manicure processes, and more particularly to what is referred to as "french" manicures.

At the present time a french manicure as accomplished by manicurists has certain disadvantages. One of them is the length of time required to produce a cured white tip on the fingernail. The white tip consists of a white lacquer application for the nail tip, and up to one-half hour is required for curing or drying of the lacquer before nail polish can be overlaid onto the dried white tip. Another disadvantage is the tendency of the white tip to chip or wear, with time. A further disadvantage is the need for a bulky bottle containing the white lacquer to be applied to the nail tip. There is need for a process which avoids the above problems and disadvantages.

SUMMARY OF THE INVENTION

It is a major object of the invention to provide a french manicure process which meets the above need.

Further advantages include the provision of a manicure process wherein the application of the white tip is rapid, and does not require drying or curing of lacquer; and the provision of a durable white tip.

The above advantages and objects are, according to the invention, embodied in a process that includes the steps:

(a) providing a flexible tab having a white or near-white upper surface that is compatible to nail polish, the tab having the shape of an over-sized fingernail forward tip portion, (b) applying and adhering the tab to the fingernail forward tip portion so that the tab has extent beyond the forward edge of the fingernail forward tip portion, (c) then trimming off said tab extent beyond the forward edge of the fingernail forward tip portion, (d) then applying translucent liquid nail polish to the fingernail upper surface and to cover said tab upper surface, and allowing the polish to dry, (e) whereby the fingernail has a glossy upper surface that is white or near-white only at it's forward tip portion.

Additionally, and as will appear, the method may include initially applying a liquid primer coating to the fingernail upper surface, and allowing that coating to dry, whereby the tab is adherent to the coating.

Further, an adhesive may be provided between the tab and the fingernail forward portion; and in this regard, the tab may be provided with a pressure-sensitive adhesive under surface. Said adhering step comprises pressing the tab under surface onto the fingernail forward tip portion so that said adhesive under surface adheres thereto.

Also, and typically, multiple of said tabs are provided, and steps b) through d) are repeated for each of the fingernails on a human hand; and in this regard, a carrier sheet may be provided on which different size tabs are removably carried, and including selectively removing the tabs from said sheet at the time of tab application to the fingernail forward tip portion.

These and other objects and advantages of the invention will be more fully understood from the following description and drawings, in which:

DRAWING DESCRIPTION

FIG. 1 is a side elevation showing a finger and fingernail;

FIG. 2 is a top plan view of a fingernail showing steps of the process;

FIG. 2*a* is a view like FIG. 2 showing a modification;

FIGS. 3*a*, 3*b* and 3*c* are enlarged elevations, in section, showing steps of the process;

FIG. 4 is a further enlarged fragmentary elevation, in section, showing a french manicure tab, and adhesive;

FIG. 5 is a view like FIG. 3*c*, showing application of the invention to an artificial fingernail, or nail tip; and FIG. 6 is a fragmentary view of a carrier sheet carrying multiple of the tabs, of different sizes.

DETAILED DESCRIPTION

In FIG. 1, a human finger or digit 10 has a fingernail 11. A French manicure normally involves application of a white upper tip 12 to the nail or by carefully brushing on a crescent-shaped configuration, or for example may consist of white enamel which requires up to one-half hour cure or drying time. This is time consuming and relatively expensive in manicurist's time, considering ten applications to fingernails and thumb-nails of both hands.

FIG. 6 shows a carrier sheet 13 on which a number of different size, crescent-shaped flexible, thin sheet-like tabs 14 are loosely carried, to be easily selected and removed, one by one. For example, the tabs may consist of synthetic resin, such as MYLAR, or the like of thickness between 0.003 and 0.015 inch. Other materials are usable. The tabs have arcuate corners at 14*a*, joining rearward and forward crescent-shaped edges 14*b* and 14*c*, as in FIG. 2. The tab is intended to be applied to a fingernail forward portion to overhang its forward edge 11*a*, and for this purpose the tab has the general shape of an oversized fingernail forward tip portion. This allows adjustment in the intended size of the resultant french manicure tip; for example, edge 14*b* may be applied to the fingernail in further-back position as seen in FIG. 2*a*, yielding a resultant larger french manicure tip.

After press-down adherence of the tab to the nail forward tip portion, the tab excess (beyond the nail forward edge 11*a*) is trimmed away, as by a scissors or blade, indicated at 15 in FIG. 2, thereby shaping the forward edge 14*c*' of the tab to conform to the forward edge 11*a* of the nail. Thereafter, translucent liquid nail polish may be applied to the tip surface 11*b* of the nail, and to the tip surface 14*d* of the tab, to cover said surface or surfaces, yielding after cure a fingernail glossy upper surface which is white or near-white only at the tab-covered forward tip portion. The cured hard layer of polish also protects the tab, and its application to the forward edges 11*a* and 14*c*', bonds them together and protect them.

FIG. 3 shows multiple steps of a process embodying the invention. In FIG. 3*a*, a thin protective liquid primer coating 16 is applied to the entire upper surface of the nail 11, as by a brush 17. After rapid cure of the coating 16, the tab 14 is applied and adhered to the coating covering the nail forward tip portion, and the tab excess is trimmed away, as described, yielding the FIG. 3*b* configuration. This step requires only about a minute or two. Thereafter, liquid polymer nail polish 18 is applied in a thin coating over the upper surface of the coating 16 and over the upper surface of the tab 14, and the polish allowed to cure. As a result, the nail has a glossy, attractive upper surface that is white or near-white (or other color) only at its forward tip portion, the tab 14 also offering protection to the nail forward portion.

FIG. 4 shows the tab to consist of a flexible sheet **14*e* (MYLAR or the like), and a pressure-sensitive adhesive under layer 14*f*** adapting the tab to be applied to the nail press-on technique. Such pressure-sensitive adhesives are well known. Alternatively, a glue may be applied between the tab and the nail or primer coat surface to quickly adhere the tab to the nail. One such glue is the product marketed under the name "CRAZY GLUE".

FIG. 5 shows the tab 14 applied to the forwardmost upper surface extent of an artificial fingernail, or nail tip 20. The latter is attached to the natural nail 11, as at interface 21, quick drying glue being used for that purpose. Nail polish coating 22 covers the upper surfaces of the nail 11, nail 20, and tab 14, providing a dressy and protective french manicure to an artificial nail or nail top extending previously from a natural nail.

I claim:

1. The method of rapidly accomplishing a durable french manicure, employing nail polish, that includes the steps:

(a) providing a flexible tab having a white or near-white upper surface that is compatible to nail polish, the tab having the shape of an over-sized fingernail forward tip portion, (b) applying and adhering the tab to the fingernail forward tip portion so that the tab has extent beyond the forward edge of the fingernail forward tip portion, (c) then trimming off said tab extent beyond the forward edge of the fingernail forward tip portion, (d) then applying translucent liquid nail polish to the fingernail upper surface and to cover said tab upper surface, and allowing the polish to dry, (e) whereby the fingernail has a glossy upper surface that is white or near-white only at it's forward tip portion.

2. The method of claim 1 including initially applying a liquid primer coating to the fingernail upper surface, and allowing that coating to dry, whereby the tab is adherent to the coating.

3. The method of claim 1, including providing the tab with a pressure-sensitive adhesive under surface, said adhering step comprises pressing the tab under surface onto the fingernail forward tip portion so that said adhesive under surface adheres thereto.

4. The method of claim 1, including providing an adhesive between the tab and the fingernail forward tip portion.

5. The method of claim 1 wherein the polish consists of liquid polymer.

6. The method of claim 1 wherein the tab comprises a thin sheet of synthetic resin.

7. The method of claim 6 wherein said resin sheet consists of Mylar or the like.

8. The method of claim 2 including providing the tab with a pressure-sensitive adhesive under surface, and said adhering step includes pressing the tab under surface onto said dried coating on the fingernail forward tip portion so that said adhesive adheres thereto.

9. The method of claim 2 including providing an adhesive between the tab and the dried coating on the fingernail forward tip portion.

10. The method of one of claims 4 and 9 wherein said adhesive consists of glue or the like.

11. The method of claim 1 wherein multiple of said tabs are provided, and steps (b) through (d) are repeated for each of the fingernails on a human hand.

12. The method of claim 11 including providing a carrier sheet on which said tabs are removably carried, and including selectively removing the tabs from said sheet at the time of tab application to the fingernail forward tip portion.

13. The method of claim 1 wherein said fingernail is a natural fingernail.

14. The method of claim 1 wherein the fingernail is a artificial fingernail.

15. The method of claim 1 wherein said trimming step is carried out to form a tab forward edge co-terminous with a forward edge defined by the fingernail, and said application of nail polish is carried out to cover the tab and fingernail forward edges to bond them together and cover same.

16. The product produced by the method of claim 14.

17. The product produced by the method of claim 15.

18. The method of rapidly accomplishing a durable manicure, employing nail adherent liquid that cures and is translucent, that includes the steps:

(a) providing a flexible tab having a white or near-white upper surface that is compatible to said liquid, the tab being over-sized relative to a fingernail forward tip position, (b) applying and adhering the tab to the fingernail forward tip portion so that the tab has extent beyond the forward edge of the fingernail forward tip portion, (c) then trimming off said tab extent beyond the forward edge of the fingernail forward tip portion, (d) then applying said liquid to the fingernail upper surface and to cover said tab upper surface, and allowing the liquid to dry, (e) whereby the fingernail has a glossy upper surface that is white or near-white only at it's forward tip portion.

19. The method of claim 18 wherein the fingernail is an artificial fingernail.

* * * * *